US008432344B2

(12) United States Patent
Yeom et al.

(10) Patent No.: US 8,432,344 B2
(45) Date of Patent: Apr. 30, 2013

(54) LIQUID CRYSTAL DISPLAY

(75) Inventors: Joo-seok Yeom, Gwacheon-si (KR); Chang-hyun Shin, Suwon-si (KR)

(73) Assignee: Samsung Display Co., Ltd., Yongin (KR)

( * ) Notice: Subject to any disclaimer, the term of this patent is extended or adjusted under 35 U.S.C. 154(b) by 1325 days.

(21) Appl. No.: 12/127,512

(22) Filed: May 27, 2008

(65) Prior Publication Data

US 2009/0295693 A1 Dec. 3, 2009

(51) Int. Cl.
*G09G 3/36* (2006.01)
*G09G 5/02* (2006.01)

(52) U.S. Cl.
USPC ..... 345/92; 345/87; 345/695

(58) Field of Classification Search ..... 345/87–104, 345/204–215, 690–699
See application file for complete search history.

(56) References Cited

U.S. PATENT DOCUMENTS

| | | | | |
|---|---|---|---|---|
| 6,445,372 | B1 * | 9/2002 | Asai | 345/99 |
| 7,483,090 | B2 * | 1/2009 | Shin et al. | 349/38 |
| 7,576,724 | B2 * | 8/2009 | Lin et al. | 345/98 |
| 8,031,287 | B2 * | 10/2011 | Um et al. | 349/48 |
| 8,194,201 | B2 * | 6/2012 | Um et al. | 349/48 |
| 2002/0044118 | A1 * | 4/2002 | Sekido et al. | 345/87 |
| 2005/0098785 | A1 * | 5/2005 | You | 257/72 |
| 2005/0179631 | A1 * | 8/2005 | Lyu | 345/87 |
| 2006/0097972 | A1 * | 5/2006 | Takeuchi et al. | 345/90 |
| 2006/0145985 | A1 * | 7/2006 | Hwang et al. | 345/92 |
| 2007/0013643 | A1 * | 1/2007 | Hong et al. | 345/100 |
| 2007/0018922 | A1 * | 1/2007 | Lee et al. | 345/89 |
| 2007/0058123 | A1 * | 3/2007 | Um et al. | 349/144 |
| 2007/0097307 | A1 * | 5/2007 | Kim et al. | 349/143 |
| 2007/0109238 | A1 * | 5/2007 | Lee et al. | 345/87 |
| 2007/0159587 | A1 * | 7/2007 | Kim et al. | 349/144 |
| 2007/0195049 | A1 * | 8/2007 | Choi et al. | 345/98 |
| 2008/0024689 | A1 * | 1/2008 | Ahn | 349/43 |
| 2008/0180370 | A1 * | 7/2008 | Huang et al. | 345/87 |
| 2009/0009458 | A1 * | 1/2009 | Bae et al. | 345/92 |
| 2009/0153759 | A1 * | 6/2009 | Um et al. | 349/39 |
| 2009/0195488 | A1 * | 8/2009 | Takeuchi et al. | 345/90 |
| 2011/0128455 | A1 * | 6/2011 | Tsubata | 348/790 |
| 2011/0309367 | A1 * | 12/2011 | Um et al. | 257/59 |

FOREIGN PATENT DOCUMENTS

| | | |
|---|---|---|
| JP | 2003107503 | 4/2003 |
| JP | 2006171342 | 6/2006 |
| KR | 1020070071415 | 7/2007 |

* cited by examiner

*Primary Examiner* — Alexander Eisen
*Assistant Examiner* — Patrick F Marinelli
(74) *Attorney, Agent, or Firm* — H.C. Park & Associates, PLC

(57) ABSTRACT

The present invention provides a liquid crystal display comprising a pixel electrode comprising a first sub-pixel electrode, a second sub-pixel electrode and a third sub-pixel electrode, separated from each other; a first thin film transistor connected to the first sub-pixel electrode; a second thin film transistor connected to the second sub-pixel electrode; a gate line connected to the first thin film transistor and the second thin film transistor; a data line, insulated from and crossing the gate line, connected to the first thin film transistor and the second thin film transistor; and a first storage line, parallel with the gate line, extending across the first sub-pixel electrode, wherein the first and second thin film transistors comprise a gate electrode connected to the gate line, a source electrode connected to the data line and a drain electrode connected to the first sub-pixel electrode and the second sub-pixel electrode respectively, and the drain electrode of the first or second thin film transistor overlaps with the third sub-pixel electrode.

17 Claims, 8 Drawing Sheets

LIQUID CRYSTAL DISPLAY

BACKGROUND OF THE INVENTION

1. Field of the Invention

The present invention relates to a liquid crystal display.

2. Discussion of the Background

Liquid crystal displays (LCDs) are one of the most widely used flat panel displays. An LCD includes a pair of substrates provided with field-generating electrodes, such as pixel electrodes and a common electrode, and a liquid crystal (LC) layer interposed between the two substrates. The LCD displays images when voltages are applied to the field-generating electrodes, thereby generating an electric field in the LC layer that determines the orientations of LC molecules therein to adjust polarization of incident light.

Among LCDs, a vertical alignment (VA) mode LCD, which aligns LC molecules such that the long axes thereof are perpendicular to the substrates in the absence of an electric field, is spotlighted because of its high contrast ratio and wide viewing angle.

The wide viewing angle of the VA mode LCD may be realized by cutouts or openings in the field-generating electrodes. Since the cutouts may determine the tilt directions of the LC molecules, the tilt directions may be distributed in several directions using the cutouts such that the viewing angle is widened.

However, the VA mode LCD has poor lateral visibility as compared with front visibility. To improve the lateral visibility of the VA mode LCD, one pixel may be divided into two sub-pixels and different voltages may be applied to each sub-pixel. One sub-pixel receives a higher voltage through a switching element and the other sub-pixel may be coupled to the sub-pixel connected to the switching element through a coupling capacitor so that it may receive a lower voltage.

However, when connecting two sub-pixels with a coupling capacitor, the pixels may discharge more slowly, thereby generating image sticking. Also, the color and luminance of the LCD are not naturally visible on the lateral side since the lateral gamma curve changes abruptly.

SUMMARY OF THE INVENTION

The present invention provides an LCD that may prevent the generation of image sticking and improve lateral visibility by preventing a delay of an electric discharge of pixels.

Additional features of the invention will be set forth in the description which follows, and in part will be apparent from the description, or may be learned by practice of the invention.

The present invention discloses a liquid crystal display comprising a pixel electrode comprising a first sub-pixel electrode, a second sub-pixel electrode and a third sub-pixel electrode, separated from each other. First and second thin film transistor are connected to the first and second sub-pixel electrodes respectively. A gate line is connected to the first thin film transistor and the second thin film transistor. A data line is insulated from and crossing the gate line, connected to the first thin film transistor and the second thin film transistor. A first storage line extends across the first sub-pixel electrode parallel with the gate line. The first storage line is supplied with a voltage with a period smaller than one frame time. The first and second thin film transistors comprise a gate electrode connected to the gate line, a source electrode connected to the data line and a drain electrode connected to the first sub-pixel electrode and the second sub-pixel electrode respectively, and the drain electrode of the first or second thin film transistor overlaps with the third sub-pixel electrode. A voltage applied to the first sub-pixel electrode is higher than a voltage applied to the second sub-pixel electrode, and the voltage applied to the second sub-pixel electrode is higher than a voltage applied to the third sub-pixel electrode. At least one of the first, second and third sub-pixel electrodes further comprises a plurality of slits to speed up the movement of liquid crystal molecules. The liquid crystal display further comprises a second storage line extending across the second sub-pixel electrode or the third sub-pixel electrode.

The present invention also discloses a liquid crystal display a first substrate comprising a gate line formed on the first substrate and a data line crossing the gate line. A plurality of pixels is connected to the gate line and the data line, and each pixel comprises a first sub-pixel electrode, a second sub-pixel electrode and a third sub-pixel electrode, separated from each other. A first storage line, parallel with the gate line, extending across the first sub-pixel electrode. A second substrate comprises a common electrode formed on the second substrate so as to apply a reference voltage. A liquid crystal layer is disposed between the first substrate and the second substrate. First, second and third liquid crystal capacitors are formed by the first, second and third sub-pixel electrodes, the common electrode and the liquid crystal layer therebetween. First and second thin film transistor are connected to the first and second sub-pixel electrodes respectively. The first and second thin film transistors comprise a gate electrode connected to the gate line, a source electrode connected to the data line and a drain electrode connected to the first sub-pixel electrode and the second sub-pixel electrode respectively, and each pixel comprises a coupling capacitor formed by overlapping the drain electrode of the first or second thin film transistor with the third sub-pixel electrode. At least one of the first, second and third sub-pixel electrodes and the common electrode comprise a plurality of slits to speed up the movement of liquid crystal molecules. The liquid crystal display further comprises a light blocking member, formed on the first substrate or the second substrate, including linear portions corresponding to the data line and the gate line so as to prevent light leakage between the pixels. A plurality of color filters is formed on the first substrate or the second substrate, disposed substantially in the areas enclosed by the light blocking member.

The present invention also discloses a method for manufacturing an array substrate, the method comprising forming a gate line, a gate electrode and a first storage line parallel with the gate line; forming a gate insulating layer on the gate line and the first storage line; forming a plurality of semiconductor islands on the gate insulating layer; forming a data line crossing the gate line on the gate insulating layer, source electrodes and drain electrodes on each semiconductor island; forming a passivation layer comprising a plurality of contact holes exposing the drain electrode and the gate line; and forming a pixel electrode comprising a first sub-pixel electrode, a second sub-pixel electrode and a third sub-pixel electrode, separated from each other. Each of the first and second sub-pixel electrode connects to the drain electrode through the contact hole, the first storage line extends across the first sub-pixel electrode, and at least one of the drain electrodes overlaps with the third sub-pixel electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
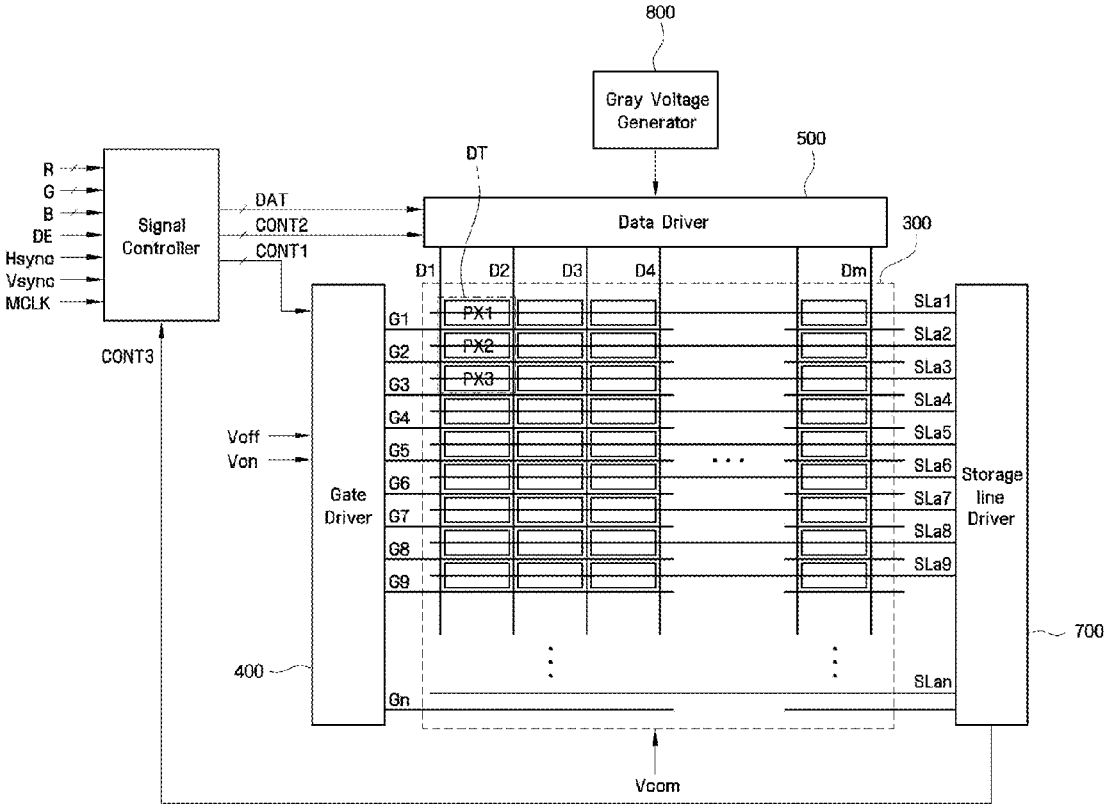
FIG. 1 is a block diagram of an LCD according to an exemplary embodiment of the present invention.

The invention is described more fully hereinafter with reference to the accompanying drawings, in which embodiments of the invention are shown. This invention, may however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements of layers may be present.

LCDs according to exemplary embodiments of the present invention will be described in detail below with reference to the accompanying drawings.

Figure 2:
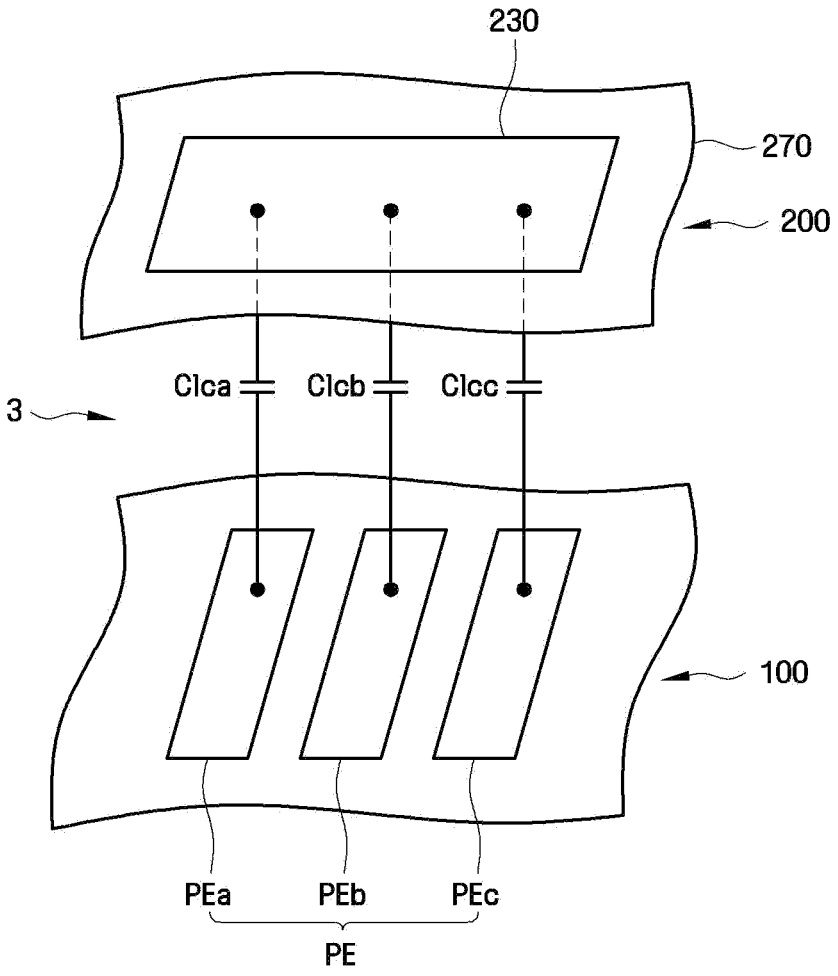
FIG. 2 is a structural view of three sub-pixels in a pixel of an LCD according to an exemplary embodiment of the present invention.
Figure 3:
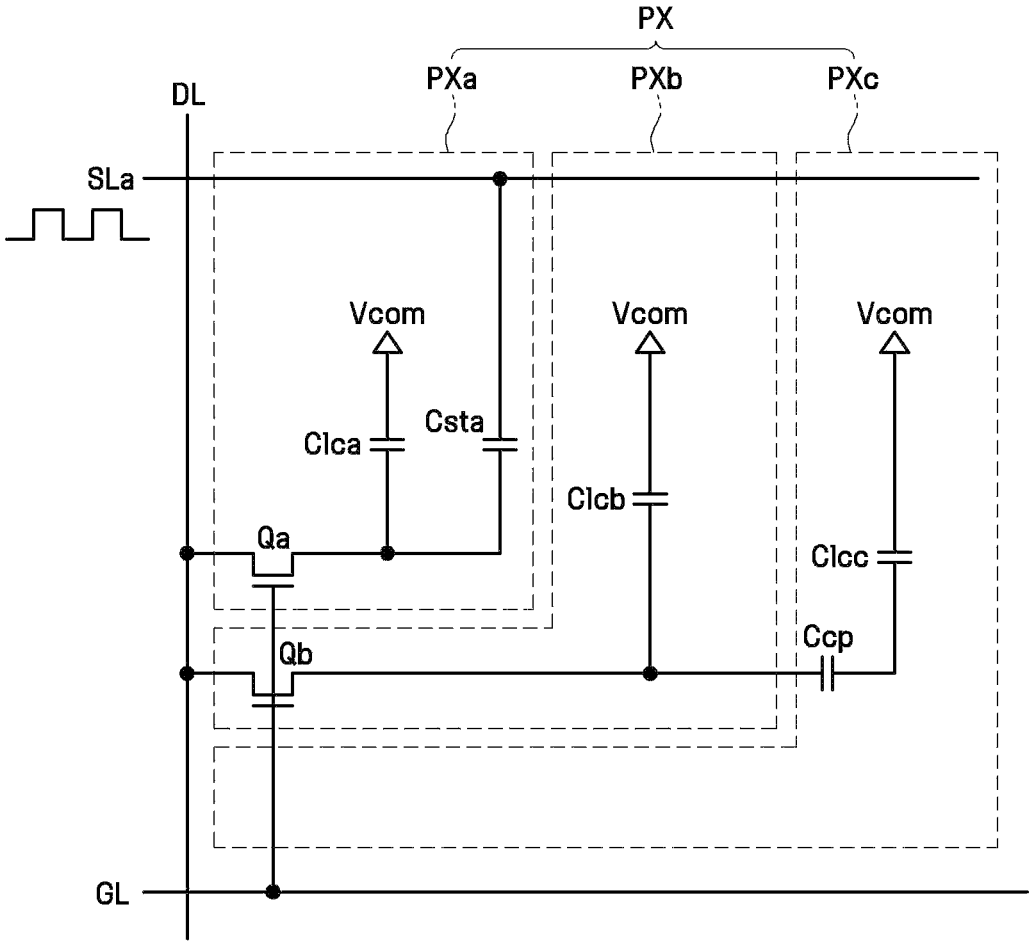
FIG. 3 is an equivalent circuit diagram of three sub-pixels in a pixel of an LCD according to an exemplary embodiment of the present invention.

FIG. 1 is a block diagram of an LCD according to an exemplary embodiment of the present invention, FIG. 2 is a structural view of three sub-pixels in a pixel of an LCD according to an exemplary embodiment of the present invention and FIG. 3 is an equivalent circuit diagram of three sub-pixels in a pixel of an LCD according to an exemplary embodiment of the present invention.

As shown in FIG. 1, an LCD according to an exemplary embodiment of the present invention includes an LC panel assembly 300, a gate driver 400 and a data driver 500 connected to the LC panel assembly 300, a gray voltage generator 800 connected to the data driver 500, a storage line driver 700 connected to the LC panel assembly 300 and a signal controller 600 to control the above elements. The gate driver 400 may include a pair of drivers disposed at respective sides of the LC panel assembly 300.

The LC panel assembly 300 includes a plurality of signal lines G1-Gn, D1-Dm and SLa1-SLan, and a plurality of pixels PX1, PX2, and PX3 connected to the signal lines and arranged substantially in a matrix, as seen in FIG. 1. The LC panel assembly 300 includes lower and upper substrates 100 and 200 that face each other and an LC layer 3 interposed between the lower and upper substrates 100 and 200, as in the structural view shown in FIG. 2.

The signal lines G1-Gn, D1-Dm and Sla1-SLan include a plurality of gate lines G1-Gn to transmit gate signals (also referred to as "scanning signals"), a plurality of data lines D1-Dm to transmit data signals and a plurality of storage lines SLa1-SLan to transmit storage signals. The gate lines G1-Gn and the storage lines SLa1-SLan extend substantially in a row direction and are substantially parallel to each other, and the data lines D1-Dm extend substantially in a column direction and are substantially parallel to each other.

Each pixel PX1, PX2, and PX3 has an elongated shape and extends in the row direction, and includes a first, second and third sub-pixels PXa, PXb and PXc. Each pixel includes an LC capacitor Clca, Clcb and Clcc respectively, and the first and second sub-pixel PXa and PXb include switching elements Qa and Qb connected to the signal lines respectively.

The switching element including a thin film transistor is a three-terminal element provided on the lower substrate 100, and the control terminal thereof is connected to the gate line Gn, the input terminal thereof is connected to the data line Dm, and the output terminal thereof is connected to an LC capacitor Clca or Clcb, a coupling capacitor Ccp or a storage capacitor Csta.

The LC capacitor Clca, Clcb or Clcc is formed by a sub-pixel electrode PEa, PEb or PEc provided on the lower substrate 100 and a common electrode 270 provided on an upper substrate 200 as two terminals, and the LC layer 3 disposed between the sub-pixel electrode PEa, PEb or PEc and the common electrode 270 as a dielectric material. The sub-pixel electrodes PEa, PEb and PEc are separated from each other and together form a pixel electrode PE. The common electrode 270 is formed on the entire surface of the upper substrate 200 and supplied with a common voltage Vcom.

The first sub-pixel PXa includes the first switching element Qa, the first storage capacitor Csta connected to a first storage line SLa. The first storage capacitor Csta functioning as an auxiliary capacitor for the first liquid crystal capacitor Clca is formed by overlapping another signal line SLa provided on the lower substrate 100 with the pixel electrode PE via an insulator disposed therebetween, and this signal line is supplied with an alternating current voltage, in other words AC voltage swinging between predetermined ranges. The second sub-pixel PXb includes a second switching element Qb and may include a second storage capacitor (not shown). The third sub-pixel PXc includes the coupling capacitor Ccp formed by overlapping an extended drain electrode of the second switching element Qb with the sub-pixel electrode PEc and may include a third storage capacitor (not shown).

In the meantime, in order to implement a color display, each pixel PX1, PX2, and PX3 uniquely displays one of the primary colors (spatial division) or each pixel PX1, PX2, and PX3 sequentially displays the primary colors in turn (temporal division) so that a spatial or temporal sum of the primary colors are recognized as a desired color. An example of a set of the primary colors is three primary colors including red, green, and blue. FIG. 2 shows an example of the spatial division in which each pixel PX1, PX2, PX3 includes a color filter 230 representing one of the primary colors in an area of the upper substrate 200 facing the pixel electrode PE. Unlike FIG. 2, the color filter 230 may be provided on or under the pixel electrode PE on the lower substrate 100. Color filters 230 of the pixels PX1, PX2, and PX3 that are adjacent to each other in a row direction are connected to each other to extend along the row direction, and color filters 230 representing different colors from each other are alternately arranged in the column direction.

In this way, pixels PX1, PX2, and PX3, which represent three primary colors, form a dot DT that is a fundamental unit for displaying images.

Referring to FIG. 1 again, the gate driver 400 is connected to the gate lines G1-Gn of the LC panel assembly 300 and synthesizes a gate-on voltage Von and a gate-off voltage Voff to generate gate signals, which are applied to the gate lines G1-Gn.

The data driver 500 is connected to the data lines D1-Dm of the LC panel assembly 300 and selects the gray voltages supplied from the gray voltage generator 800 and then applies a selected gray voltage to the data lines D1-Dm as a data signal.

The storage line driver 700 is connected to the storage lines SLa1-SLan of the LC panel assembly 300 and applies storage voltages.

Each driver 400 and 500 mentioned above may be directly mounted on the LC panel assembly 300 in the form of at least one integrated circuit (IC) chip. Alternatively, each driver 400 and 500 may be mounted on a flexible printed circuit film (not shown) in a tape carrier package (TCP) type that is attached to the LC panel assembly 300 or on a separate printed circuit board (not shown). As yet another alternative, each driver 400 and 500 may be integrated with the LC panel assembly 300, the signal lines G1-Gn, D1-Dm, and the switching elements.

The signal controller 600 may control the gate driver 400 and the data driver 500.

Now, a structure of the LC panel assembly will be described in detail with reference to FIG. 4, FIG. 5, and FIG. 6 along with FIG. 1, FIG. 2 and FIG. 3 described above.

Figure 4:
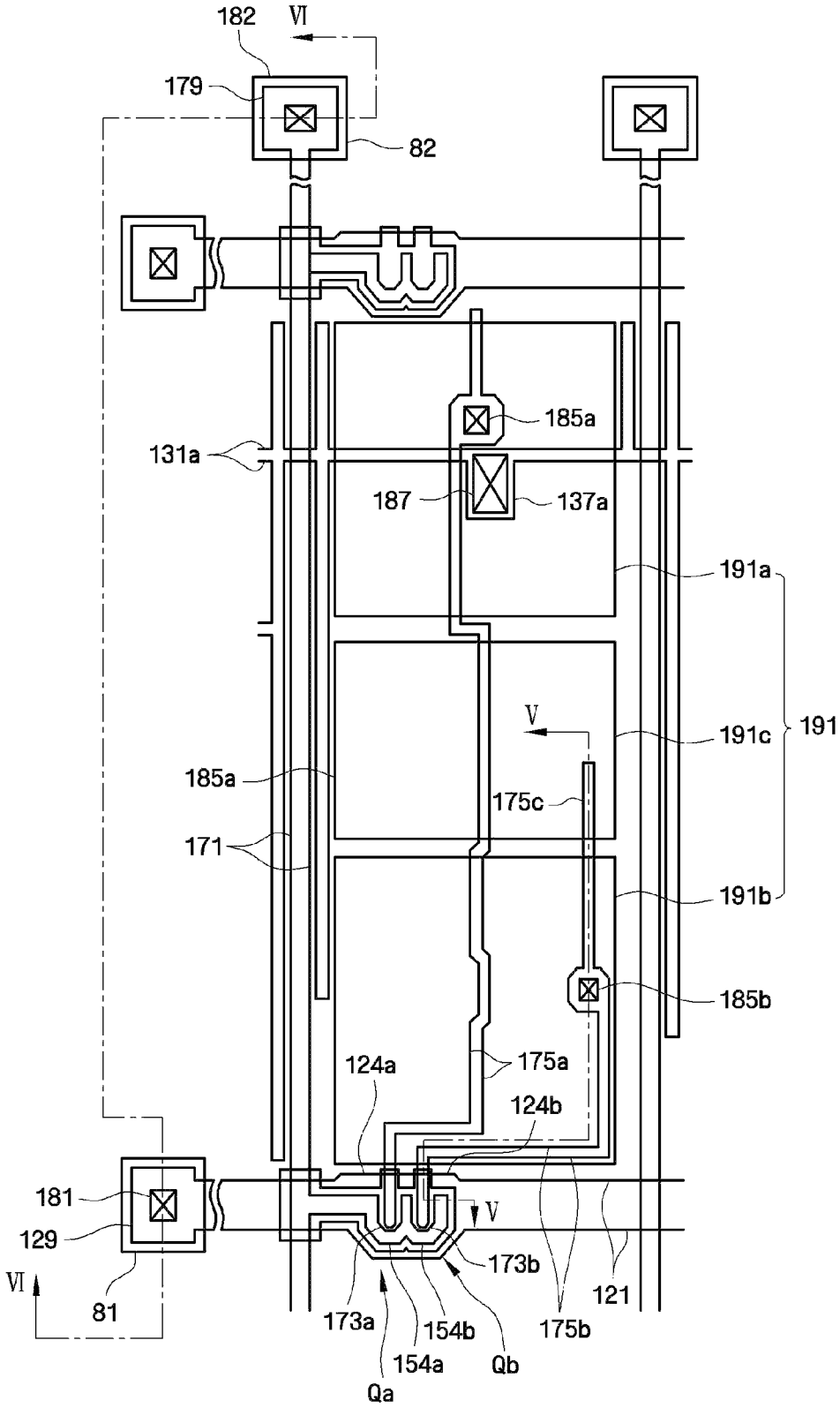
FIG. 4 is a layout view of an LCD to an exemplary embodiment of the present invention.
Figure 5:
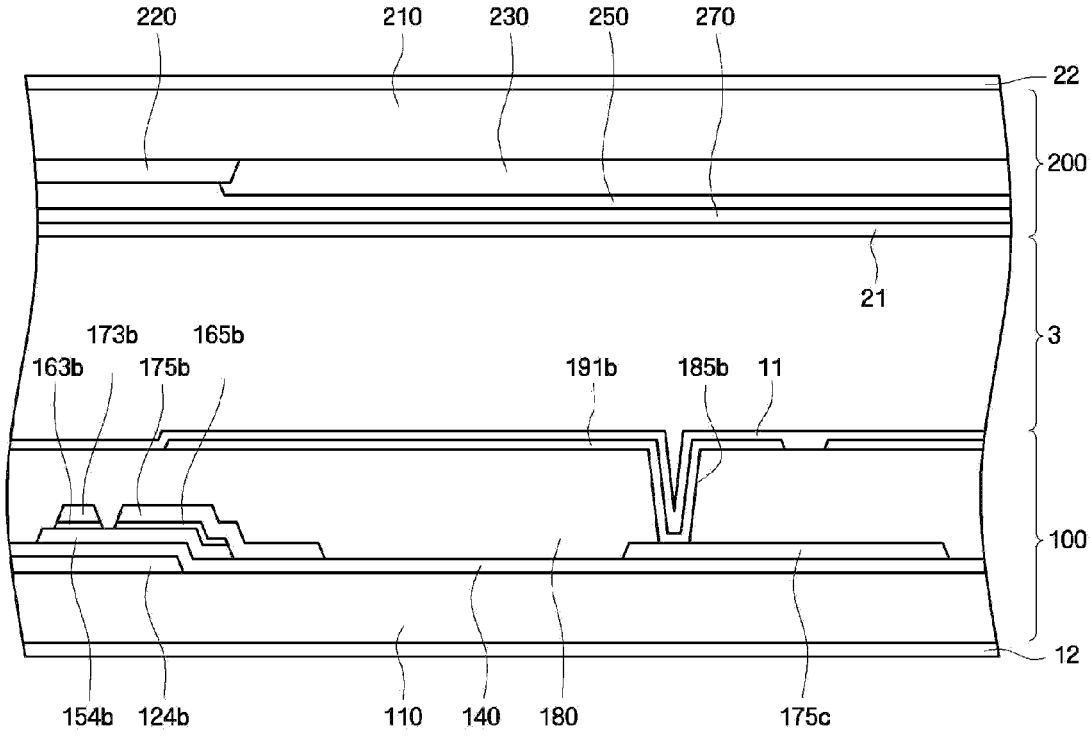
FIG. 5 and FIG. 6 are cross-sectional views of the LCD shown in FIG. 4 taken along line V-V and line VI-VI, respectively.
Figure 6:
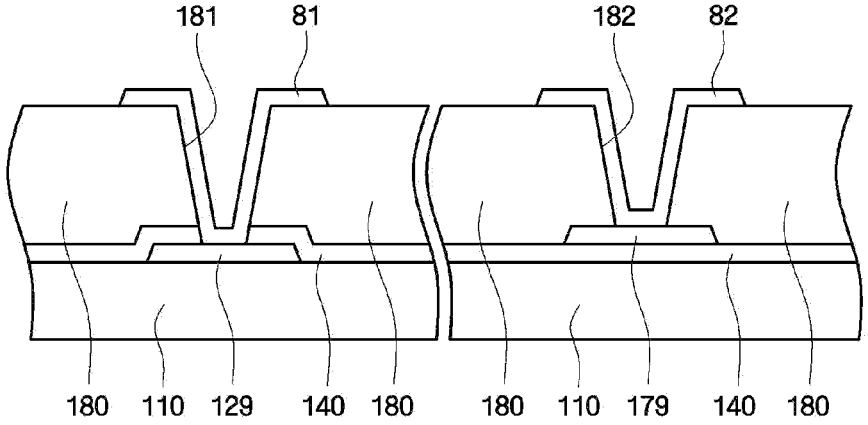

FIG. 4 is a layout view of an LCD to an exemplary embodiment of the present invention, and FIGS. 5 and 6 are cross-sectional views of the LCD shown in FIG. 4 taken along line V-V and line VI-VI, respectively.

An LCD according to an exemplary embodiment of the present invention includes a lower substrate 100, an upper substrate 200 opposing the lower substrate 100 and an LC layer 3 interposed between the two substrates 100 and 200.

First, the lower substrate 100 will be described in detail with reference to FIG. 4, FIG. 5, and FIG. 6.

A plurality of gate lines 121 is formed on an insulating substrate 110, which may include transparent glass.

The gate lines 121, which are spaced from each other, extend substantially in a row direction and transmit gate signals. Each gate line 121 includes a plurality of first and second gate electrodes 124*a* and 124*b* at each pixel. The first and second gate electrodes 124*a* and 124*b* may separately extend from the gate lines 121, but make up one body such that a portion of the body is used as the first gate electrodes 124*a* and the remaining portion of the body is used as the second electrodes 124*b*.

The gate lines 121 may include an aluminum—(Al) containing metal such as Al and an Al alloy, a silver—(Ag) containing metal such as Ag and a Ag alloy, a copper—(Cu) containing metal such as Cu and a Cu alloy, a molybdenum—(Mo) containing metal such as Mo and a Mo alloy, chromium (Cr), tantalum (Ta), titanium (Ti), or a combination thereof. Alternatively, the gate lines 121 may have a multi-layered structure including two conductive layers (not shown) having different physical properties. One of the two conductive layers may include a low resistivity metal, such as an Al-containing metal, an Ag-containing metal, or a Cu-containing metal, to reduce signal delay or voltage drop in the gate lines 121 and storage electrode lines 131. The other conductive layer may include a material such as a Mo-containing metal, Cr, Ti, and Ta, which has good contact characteristics with other materials such as indium tin oxide (ITO) and indium zinc oxide (IZO).

Also, the lateral sides of the gate lines 121 are inclined relative to a surface of the substrate 110, and the inclination angle thereof may range from about 30 degrees to about 80 degrees.

The storage electrode line 131*a* extends across the first sub-pixel PXa substantially in the row direction and is supplied with the AC voltage swinging between predetermined ranges. The storage electrode line 131*a* is positioned between the neighboring gate lines and includes at least one storage electrode 137*a* in the first sub-pixel PXa. Although not shown in the FIGs., another storage line may extend across the second sub-pixel PXb or the third sub-pixel PXc in order to keep the applied voltage in each sub-pixel.

A gate insulating layer 140, which may include silicon nitride (SiNx), is formed on the gate lines 121 and the storage electrode lines 131*a*.

A plurality of semiconductor islands 154*a* and 154*b*, which may include hydrogenated amorphous silicon (abbreviated to "a-Si") or poly-silicon, are formed on the gate insulating layer 140.

The semiconductor islands 154*a* and 154*b* are respectively disposed on the first and second gate electrodes 124*a* and 124*b*. The semiconductor islands 154*a* and 154*b* make up one body as do the first and second gate electrodes 124*a* and 124*b*, and may be spaced apart from each other corresponding to the structure of the first and second gate electrodes 124*a* and 124*b*.

A plurality of ohmic contact islands 163*a* and 163*b*, which may include silicide or n+ hydrogenated amorphous silicon (a-Si) heavily doped with an n-type impurity such as phosphorus (P), are formed on the semiconductor islands 154*a* and 154*b*. The ohmic contact islands 163*a* and 163*b* are disposed in pairs on the semiconductors 154*a* and 154*b* respectively.

The lateral sides of the semiconductors 154*a* and 154*b* and the ohmic contact islands 163*a* and 163*b* are also inclined relative to a surface of the substrate 110, and the inclination angle thereof may range from about 30 degrees to about 80 degrees.

A plurality of data lines 171 including a plurality of first and second source electrodes 173*a* and 173*b*, a plurality of first and second drain electrodes 175*a* and 175*b* are formed on the ohmic contact islands 163*a* and 163*b* and the gate insulating layer 140.

The data lines 171 extend substantially in the column direction and cross the gate lines 121 and transmit data signals. Each data line 171 includes a plurality of first and second source electrodes 173*a* and 173*b* branched out toward the first and second gate electrodes 124*a* and 124*b* and an end portion 179 having an extended area to connect to another layer or an external driving circuit. The first and the second source electrodes 173*a* and 173*b* have upside down "U" shapes and are connected to each other to form an upside down "W" shape.

A data driving circuit (not shown) to generate the data signals may be mounted on an FPC film (not shown), which may be attached to the substrate 110, directly mounted on the substrate 110, or integrated with the substrate 110. The data lines 171 may extend to connect to a driving circuit that may be integrated with the substrate 110.

The first and second drain electrodes 175*a* and 175*b* are spaced apart from the data lines 171, and the drain electrodes 175*a* and 175*b* are opposite the first and second source electrodes 173*a* and 173*b* over the gate electrodes 124*a* and 124*b*, respectively.

Each of the first and second drain electrodes 175*a* and 175*b* includes a stick-shaped end portion, which is partially surrounded by the source electrodes 173*a* and 173*b* that are curved in the shape of a letter "U".

Each of the first and second drain electrodes 175*a* and 175*b* includes an expansion, which is not opposite the first and second source electrodes 173*a* and 173*b*, extending to connect to another layer.

The first and second gate electrodes 124*a* and 124*b*, the first and second source electrodes 173*a* and 173*b*, and the first and second drain electrodes 175*a* and 175*b*, along with the semiconductors 154*a* and 154*b*, form the first and second thin film transistors Qa and Qb. Each thin film transistor Qa and Qb has a channel formed in the semiconductors 154*a* and 154*b* disposed between the first and second source electrodes 173*a* and 173*b* and the first and second drain electrodes 175*a* and 175*b* respectively.

The first source electrode 173*a* and the second source electrode 173*b*, the first gate electrode 124*a* and the second gate electrode 124*b*, and the first semiconductor 154*a* and the second semiconductor 154*b*, which form the first thin film transistor Qa and the second thin film transistor Qb as one body, however, may be spaced apart from each other.

A passivation layer 180 is formed on the data lines 171, the first and second drain electrodes 175*a* and 175*b*, and the exposed portions of the semiconductors 154*a* and 154*b*. The passivation layer 180 may include an inorganic insulator such as silicon nitride or silicon oxide, an organic insulator, or a low dielectric insulator. The organic insulator and the low dielectric insulator may have dielectric constants that are lower than 4.0. The passivation layer 180 may include an organic insulator having photosensitivity and the surface thereof may be flat. However, the passivation layer 180 may have a double-layered structure including a lower inorganic layer and an upper organic layer, which may protect the exposed portions of the semiconductors 154*a* and 154*b* while making the most of the excellent insulating characteristics of an organic layer.

The passivation layer 180 has a plurality of contact holes 182, 185*a* and 185*b* that respectively expose the end portions 179 of the data lines 171, the first and second drain electrodes 175*a* and 175*b*. Also, another contact hole 181 exposing the end portions 129 of the gate lines 121 is formed at the gate insulating layer 140 and the passivation layer 180.

A plurality of pixel electrodes 191, a plurality of contact assistants 81 and 82, and a plurality of capacitive conductors 86 are formed on the passivation layer 180. These may include a transparent conductor such as ITO or IZO, or a reflective metal such as Al, Ag, Cr, or alloys thereof.

Figure 10:
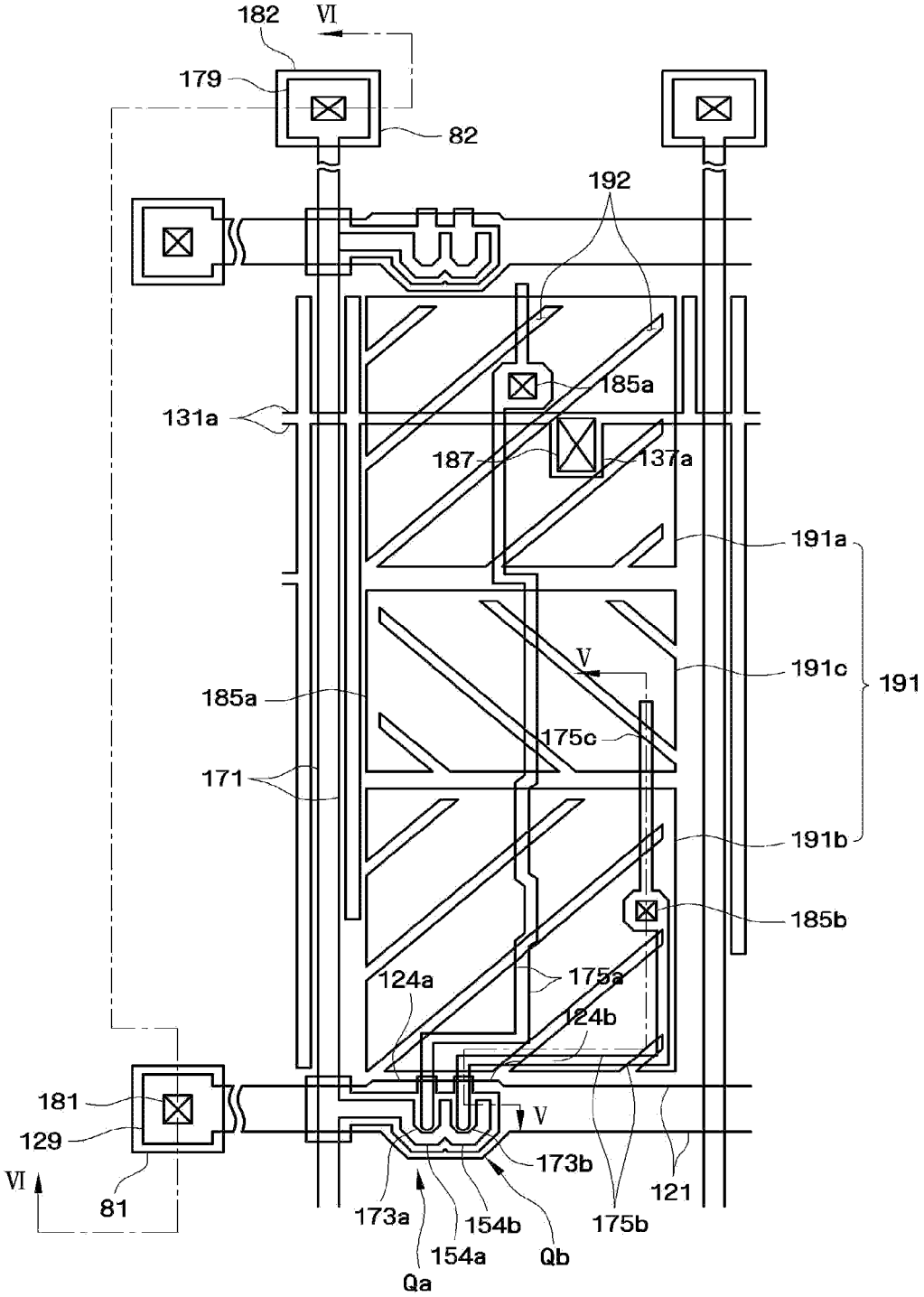
FIG. 10 is a layout view of an LCD to an exemplary embodiment of the present invention.

Each pixel electrode 191 comprises the first sub-pixel electrode 191*a*, the second sub-pixel electrode 191*b* and the third sub-pixel electrode 191*c*, separated from each other. Each sub-pixel electrode 191*a*, 191*b* and 191*c* substantially has rectangular shape. Also, the sub-pixel electrodes 191*a*, 191*b* and 191*c* can be divided by a plurality of chevron patterns, e.g. openings or protrusions. Furthermore, as shown in FIG. 10, each sub-pixel electrode may comprise a plurality of micro slits 192 of which the width is below 2.5 times of a cell gap, which defines the distance between the substrates, in order to speed up the movement of the liquid crystal molecules.

The first sub-pixel electrode 191*a* connects to the first drain electrode 175*a* through the contact hole 185*a* and the second sub-pixel electrode 191*b* connects to the second drain electrode 175*b* through the contact hole 185*b*. The third sub-pixel electrode 191*c* overlaps with the extended drain electrode 175*a* or 175*c* in order to form the coupling capacitor Ccp. The coupling capacitor Ccp includes the third sub-pixel electrode PEc and the extended drain electrode 175*a* or 175*c* as two terminals, and the passivation layer 180 disposed between the third sub-pixel electrode PEc and the extended drain electrode as a dielectric of the coupling capacitor Ccp. The capacitance of the coupling capacitor Ccp is adjusted by an area overlapping the sub-pixel electrode 191*c* with the drain electrode 175*a* or 175*b*.

Next, the upper substrate 200 will be described with reference to FIG. 4 and FIG. 5.

A light blocking member 220 is formed on an insulating substrate 210 that may include transparent glass or plastic. The light blocking member 220 is also called a black matrix and prevents light leakage. The light blocking member 220 includes linear portions corresponding to the data lines 171 and the gate lines 121 and planar portions corresponding to the thin film transistors, and it prevents light leakage between pixel electrodes 191 and defines openings that face the pixel electrodes 191.

A plurality of color filters 230 is also formed on the substrate 210. The color filters 230 are disposed substantially in the areas enclosed by the light blocking member 220, and they may extend in a column direction substantially along the pixel electrodes 191. Each color filter 230 may represent one of the primary colors such as red, green, and blue.

An overcoat 250 is formed on the color filters 230 and the light blocking member 220. The overcoat 250 may include an (organic) insulator and may prevent the color filters 230 from being exposed while providing a flat surface. The overcoat 250 may be omitted.

In the mean time, the light blocking member 220 or the color filters 230 are formed on the lower substrate 100.

The common electrode 270 is formed on the overcoat 250 so as to apply a reference voltage to the LCD panel assembly 300. The common electrode 270 may include a transparent conductive material such as ITO and IZO.

Also, the common electrode 270 can be divided by a plurality of chevron patterns, e.g. openings or protrusions parallel to the chevron pattern of the sub-pixel electrodes. Furthermore, the common electrode 270 may also include a plurality of sets of slits (not shown in FIGs.) of which the width is below 2.5 times of the cell gap in order to speed up the liquid crystal molecules.

Alignment layers 11 and 21 are coated on inner surfaces of the substrates 100 and 200. The alignment layers 11 and 12 may be homeotropic.

Polarizers 12 and 22 are provided on outer surfaces of the substrates 100 and 200. The polarization axes of the polarizers may be perpendicular to each other, and one of the polarization axes may be parallel to the gate lines 121. One of the polarizers may be omitted when the LCD is a reflective LCD.

The LCD may further include at least one retardation film (not shown) to compensate the retardation of the LC layer 3. The retardation film has birefringence and retards opposite to the LC layer 3. The retardation film may include a uniaxial or biaxial optical compensation film and in particular, may include a negative uniaxial compensation film.

The LCD may further include a backlight unit (not shown) to supply light to the LC layer 3 through the polarizer 12, the retardation film, and the substrate 100.

The LC layer 3 may have negative dielectric anisotropy and may be subjected to vertical alignment such that the LC molecules in the LC layer 3 are aligned with their long axes substantially perpendicular to the surfaces of the substrates 100 and 200 in the absence of an electric field.

Now, the operation of the LCD panel according to exemplary embodiments of the present invention will be described in detail with reference to the accompanying drawings.

Referring to FIG. 1 again, the signal controller 600 is supplied with input image signals R, G, and B and input control signals for controlling the display thereof from an external graphics controller (not shown). The input image signals R, G, and B include information on the luminance of the each pixel and the luminance is represented by the gray scale, e.g. 1024 ($=2^{10}$), 256 ($=2^{8}$) or 64 ($=2^{6}$). The input control signals include a vertical synchronization signal Vsync, a horizontal synchronization signal Hsync, a main clock signal MCLK, and a data enable signal DE.

On the basis of the input control signals, the signal controller 600 generates gate control signals CONT1, data control signals CONT2 and storage control signals CONT3, and sends the gate control signal CONT1 to the gate driver 400, sends the data control signals CONT2 to the data driver 500 and sends the storage control signals CONT3 to the storage line driver 700 in order to operate the panel assembly 300.

Also, receiving the input image signals R, G, and B, the signal controller 600 processes the input image signals R, G, and B and sends output image signals DAT to the data driver 500. The output image signals DAT include digital signals representing the gray scale.

On the basis of the data control signals CONT2, the data driver 500 receives the output image signals DAT, changes the output image signals into analog gray voltages by the gray voltage generator 800, and applies the analog gray voltages, that is, the data voltages to the data lines D1-Dm in order to operate a row of pixels PX.

Firstly, referring to FIGS. 1, 3 and 4, when the gate driver applies a gate on voltage Von to one of the gate lines G1-Gn according to the gate control signals CONT1, the first and second thin film transistors Qa and Qb are turned on by the gate on voltage Von applied to the gate line 121*n* of the current row such that the data voltage Vd applied to the data line 171 is transmitted to the first and second sub-pixel electrodes 191*a* and 191*b* through the contact holes 185*a* and 185*b* respectively. Accordingly, the data voltage is applied to the first and second liquid crystal capacitors Clca and Clcb, and the first storage capacitor Csta.

Secondly, the third sub-pixel electrode 191*c* is charged with a coupling voltage Vc since the extended drain electrode 175*a* or 175*c* overlapping with the third sub-pixel electrode 191*c* is applied to the data voltage Vd. The coupling voltage Vc can be expressed as follows:

$$Vc=(ClccVcom+CcpVd)/(Clcc+Ccp)$$

Accordingly, the coupling voltage Vc is applied to the third liquid crystal capacitors Clcc and the coupling capacitor Ccp.

Figure 7:
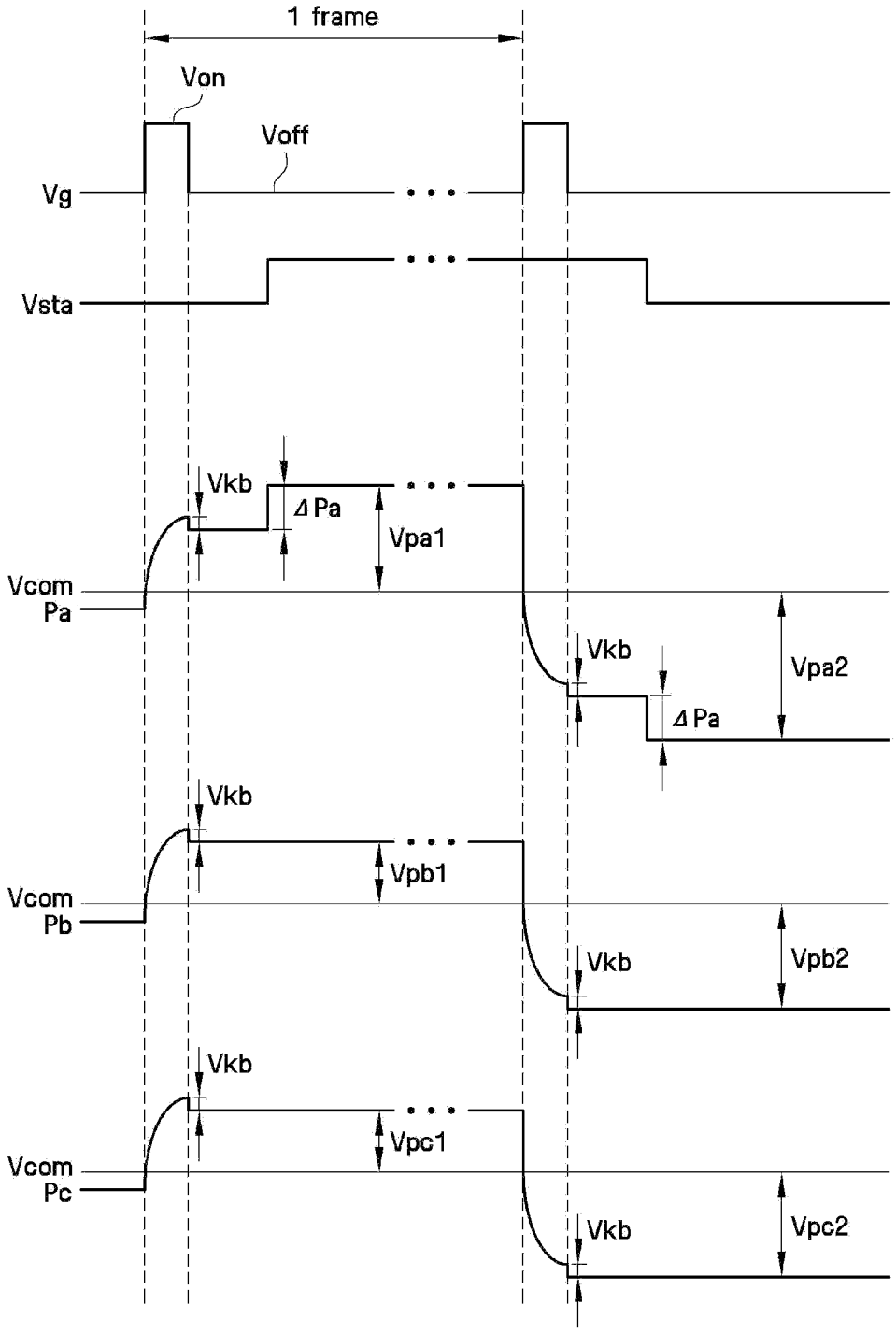
FIG. 7 is a timing chart of three sub-pixel voltages applied to one pixel of an LCD according to an exemplary embodiment of the present invention.

As shown in FIG. 7, each sub-pixel electrode voltage Pa, Pb and Pc applied to the first, second and third liquid crystal capacitors is increased respectively at a predetermined level simultaneously until the first and second thin film transistors Qa and Qb are turned off by a gate off voltage Voff applied to the gate line 121*n*. When the first and second thin film transistors Qa and Qb are turned off, the first, second and third sub-pixel electrodes 191*a*, 191*b* and 191*c* are in a floating state, and a parasitic capacitance between each drain electrode 175*a* and 175*b* and the gate line 121*n* always leads each sub-pixel electrode voltage Pa, Pb and Pc, irrespective of the polarity thereof, to a negative voltage shift, what is to say, a kick back voltage drop Vkb.

Thereafter, a voltage is applied to the first storage line SLa according to the storage control signals CONT3, and the first sub-pixel electrode voltage Pa varies in a high level at a positive polarity thereof. The voltage applied to the first storage line SLa may change the polarity thereof with a period smaller than one frame time, e.g. 16.7 ms.

As shown in FIG. 7, the first sub-pixel electrode voltage Pa is increased with ΔPa commensurate with the voltage change of the first storage line SLa. The second and third sub-pixel electrode voltage Pb and Pc keep their level irrespective of the voltage change of the first storage line SLa.

Accordingly, the first, second and third sub-pixel voltages with respect to the common voltage Vcom become Vpa1, Vpb1 and Vpc1 respectively. The absolute value of the sub-pixel voltage is sequentially Vpa1>Vpb1>Vpc1. These sub-pixel voltages keep their level during one frame.

When the voltages are charged in the first and second liquid crystal capacitors Clca, Clcb and Clcc, a vertical electric field between the lower substrate 100 and the upper substrate 200 is generated in the LC layer 3. Then, the LC molecules in the LC layer 3 tilt in response to the electric field such that their long axes become perpendicular to the field direction. The tilt of the LC molecules determines the variation of the polarization of light incident on the LC layer 3, and the variation of the light polarization is transformed into the variation of the light transmittance by the polarizers 12 and 22. In this way, the LCD may display images.

The tilt angle of the LC molecules depends on the strength of the electric field. Since the voltage Va of the first liquid crystal capacitor Clca, the voltage Vb of the second liquid crystal capacitor Clcb and the voltage Vc of the third liquid crystal capacitor Clcc are different from each other. Therefore, the tilt direction of the LC molecules in each sub-pixel is different from each other, and the luminance of the three sub-pixels becomes different. Accordingly, while maintaining the average luminance of the two sub-pixels at a target luminance, the voltages Va, Vb and Vc of the first, second and third sub-pixels may be adjusted so that the image quality viewed from a lateral side is close to the image quality viewed from the front, thereby improving the lateral visibility.

The gate driver, in response to the gate control signals, supplies the gate on voltage Von to each row of the gate lines sequentially at a period 1H which is the same as a period of the horizontal synchronization signals Hsync and the data enable signal DE, thereby the data voltage is applied to each pixel and the LCD panel assembly represents an image of one frame.

When the next frame starts, the polarity of the data voltage applied to each pixel is reversed by the data driver 500 which supplies an inversion control signal RVS. That is, through the same process as described above, the first, second and third sub-pixel voltages with respect to the common voltage Vcom become Vpa2, Vpb2 and Vpc2 respectively. The absolute value of the sub-pixel voltage is sequentially Vpa2>Vpb2>Vpc2.

Figure 8:
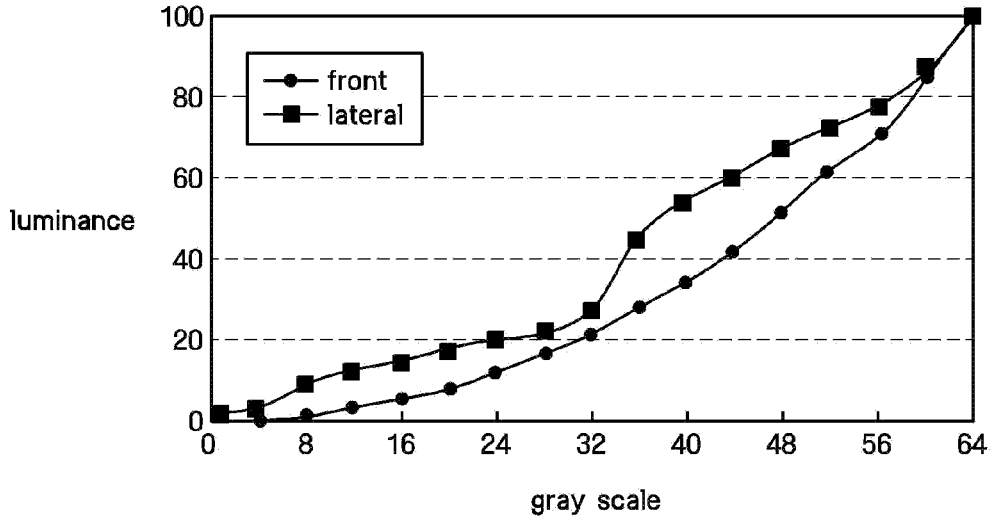
FIG. 8 is a graph illustrating a front gamma curve and a lateral gamma curve of an LCD according to the prior art.
Figure 9:
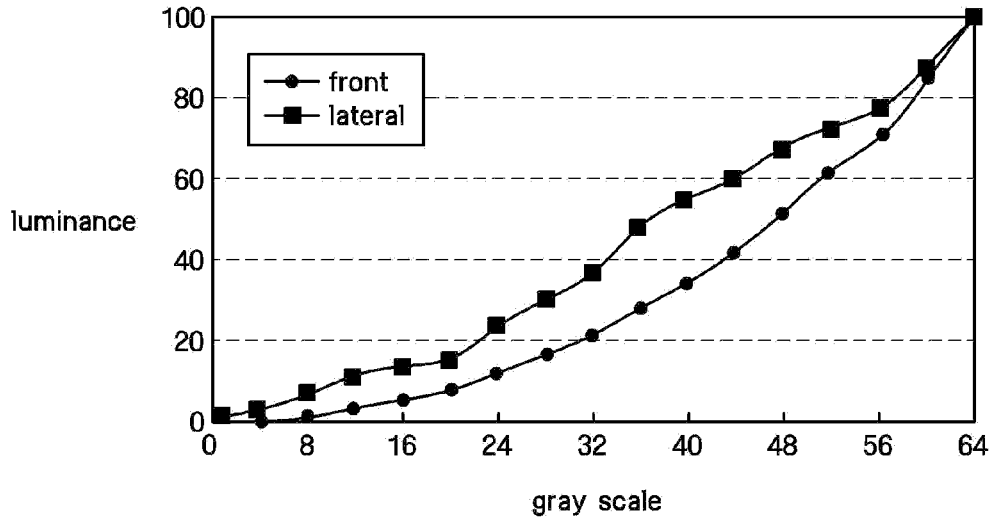
FIG. 9 is a graph illustrating a front gamma curve and a lateral gamma curve of an LCD according to an exemplary embodiment of the present invention.

Referring to FIGS. 8 and 9, effects of the LCD according to an exemplary embodiment of the present invention will be described as below. FIG. 8 is a graph illustrating the front and lateral gamma curves of a LCD according to the prior art. FIG. 9 is a graph illustrating the front and lateral gamma curves of a LCD according to an exemplary embodiment of the present invention.

The LCD according to the prior art includes a plurality of pixels having two sub-pixels separated from each other. In FIG. 8, the visibility index of this LCD is 0.250 better than that of a LCD not dividing the pixel electrodes into the sub-pixel electrodes. The visibility index is defined as a value which represents how the lateral gamma compared with the front gamma is distorted and it is preferable that the visibility index is lower. As illustrated in FIG. 8, the lateral gamma curve of the LCD according to the prior art has a deflection point and a concave portion, where the slope of the gamma curve is changed, due to the abrupt movement of the liquid crystal molecules in one sub-pixel supplied with a relatively lower voltage than the other sub-pixel. As a result, since the lateral gamma curve changes abruptly, the color and luminance of this LCD are not naturally visible on the lateral side.

In the mean time, the visibility index of the LCD according to the exemplary embodiments of the present invention is 0.204 better than that of the prior art. Also, as illustrated in FIG. 9, the lateral gamma curve of the LCD according to the present invention has no deflection point and concave portions where the slope of the lateral gamma curve is abruptly changed. It is understood that even though the liquid crystal molecules abruptly moves, two sub-pixel supplied with a relatively lower voltage than the other sub-pixel share and reduce the effect due to the abrupt movement of the liquid crystal molecules.

In the LCD shown in FIG. 3, so as to prevent the abrupt change of slope of the lateral gamma curve and improve the lateral visibility, it is preferable that the first sub-pixel voltage Vpa1 is 0.5-1.5 V higher than the third sub-pixel voltage Vpc1 and the second sub-pixel voltage Vpb1 is 0.1-1.0 V higher than the third sub-pixel voltage Vpc1.

Accordingly, the exemplary embodiments of the present invention, compared with the LCD comprising a pixel divided into two sub-pixels, can accomplish the improvement of lateral visibility and the prevention of image sticking.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A liquid crystal display comprising:

a pixel electrode comprising a first sub-pixel electrode, a second sub-pixel electrode and a third sub-pixel electrode, separated from each other;

a first thin film transistor connected to the first sub-pixel electrode;

a second thin film transistor connected to the second sub-pixel electrode;

a gate line connected to the first thin film transistor and the second thin film transistor;

a data line, insulated from and crossing the gate line, connected to the first thin film transistor and the second thin film transistor; and a first storage line, parallel with the gate line, extending across the first sub-pixel electrode, wherein the first and second thin film transistors comprise a gate electrode connected to the gate line, a source electrode connected to the data line and a drain electrode connected to the first sub-pixel electrode and the second sub-pixel electrode respectively, and the drain electrode of the first or second thin film transistor overlaps with the third sub-pixel electrode to form a coupling capacitor.

2. The liquid crystal display of claim 1, wherein at least one of the first, second and third sub-pixel electrodes comprise a plurality of slits to speed up the movement of liquid crystal molecules.

3. The liquid crystal display of claim 1, wherein the first storage line is supplied with a voltage with a period smaller than one frame time.

4. The liquid crystal display of claim 1, further comprising:

a second storage line extending across the second sub-pixel electrode or the third sub-pixel electrode.

5. A liquid crystal display, comprising:

a pixel electrode comprising a first sub-pixel electrode, a second sub-pixel electrode, and a third sub-pixel electrode, separated from each other;

a first thin film transistor connected to the first sub-pixel electrode;

a second thin film transistor connected to the second sub-pixel electrode;

a gate line connected to the first thin film transistor and the second thin film transistor;

a data line, insulated from and crossing the gate line, the data line being connected to the first thin film transistor and the second thin film transistor; and a first storage line, parallel with the gate line, and extending across the first sub-pixel electrode, wherein the first and second thin film transistors comprise a gate electrode connected to the gate line, a source electrode connected to the data line, and a drain electrode connected to the first sub-pixel electrode and the second sub-pixel electrode, respectively, wherein the drain electrode of the first or second thin film transistor overlaps with the third sub-pixel electrode, and wherein a voltage applied to the first sub-pixel electrode is higher than a voltage applied to the second sub-pixel electrode, and the voltage applied to the second sub-pixel electrode is higher than a voltage applied to the third sub-pixel electrode.

6. The liquid crystal display of claim 5, wherein the voltage applied to the first sub-pixel electrode is 0.5-1.5 V higher than the voltage applied to the second sub-pixel electrode, and the voltage applied to the second sub-pixel electrode is 0.1-1.0 V higher than the voltage applied to the third sub-pixel electrode.

7. A liquid crystal display comprising:

a first substrate comprising a gate line formed on the first substrate, a data line, insulated from the gate line, crossing the gate line, a plurality of pixels connected to the gate line and the data line, wherein each pixel comprising a first sub-pixel electrode, a second sub-pixel electrode and a third sub-pixel electrode, separated from each other, and a first storage line, parallel with the gate line, extending across the first sub-pixel electrode;

a second substrate comprising a common electrode formed on the second substrate so as to apply a reference voltage;

a liquid crystal layer disposed between the first substrate and the second substrate;

a first liquid crystal capacitor formed by the first sub-pixel electrode, the common electrode and the liquid crystal layer therebetween;

a second liquid crystal capacitor formed by the second sub-pixel electrode, the common electrode and the liquid crystal layer therebetween;

a third liquid crystal capacitor formed by the third sub-pixel electrode, the common electrode and the liquid crystal layer therebetween;

a first thin film transistor connected to the first sub-pixel electrode; and a second thin film transistor connected to the second sub-pixel electrode, wherein the first and second thin film transistors comprise a gate electrode connected to the gate line, a source electrode connected to the data line and a drain electrode connected to the first sub-pixel electrode and the second sub-pixel electrode respectively, and each pixel comprises a coupling capacitor formed by overlapping the drain electrode of the first or second thin film transistor with the third sub-pixel electrode.

8. The liquid crystal display of claim 7, wherein at least one of the first, second and third sub-pixel electrodes and the common electrode comprise a plurality of slits to speed up the movement of liquid crystal molecules.

9. The liquid crystal display of claim 7, wherein the first storage line is supplied with a voltage with a period smaller than one frame time.

10. The liquid crystal display of claim 7, further comprising:

a second storage line extending across the second sub-pixel electrode or the third sub-pixel electrode.

11. The liquid crystal display of claim 7, wherein a voltage applied to the first sub-pixel electrode is higher than a voltage applied to the second sub-pixel electrode, and the voltage applied to the second sub-pixel electrode is higher than a voltage applied to the third sub-pixel electrode.

12. The liquid crystal display of claim 11, wherein the voltage applied to the first sub-pixel electrode is 0.5-1.5 V higher than the voltage applied to the second sub-pixel electrode, and the voltage applied to the second sub-pixel electrode is 0.1-1.0 V higher than the voltage applied to the third sub-pixel electrode.

13. The liquid crystal display of claim 11, further comprising:

a light blocking member, formed on the first substrate or the second substrate, including linear portions corresponding to the data line and the gate line so as to prevent light leakage between the pixels; and a plurality of color filters, formed on the first substrate or the second substrate, disposed substantially in the areas enclosed by the light blocking member.

14. A method for manufacturing an array substrate, the method comprising:

forming a gate line, a gate electrode and a first storage line parallel with the gate line;

forming a gate insulating layer on the gate line and the first storage line;

forming a plurality of semiconductor islands on the gate insulating layer;

forming a data line crossing the gate line on the gate insulating layer, source electrodes and drain electrodes on each semiconductor island;

forming a passivation layer comprising a plurality of contact holes exposing the drain electrodes and the gate line; and forming a pixel electrode comprising a first sub-pixel electrode, a second sub-pixel electrode and a third sub-pixel electrode, separated from each other, wherein each of the first and second sub-pixel electrode connects to one of the drain electrodes through the contact hole, the first storage line extends across the first sub-pixel electrode, and at least one of the drain electrodes overlaps with the third sub-pixel electrode to form a coupling capacitor.

15. The liquid crystal display of claim 1, wherein the second and third sub-pixel electrodes and a portion of the first sub-pixel electrodes are arranged between the first storage line and the gate line.

16. The liquid crystal display of claim 7, wherein the second and third sub-pixel electrodes and a portion of the first sub-pixel electrodes are arranged between the first storage line and the gate line.

17. The method of claim 14, wherein the second and third sub-pixel electrodes and a portion of the first sub-pixel electrodes are arranged between the first storage line and the gate line.

* * * * *